United States Patent [19]

West

[11] Patent Number: 4,645,450

[45] Date of Patent: Feb. 24, 1987

[54] SYSTEM AND PROCESS FOR CONTROLLING THE FLOW OF AIR AND FUEL TO A BURNER

[75] Inventor: John S. West, Camp Hill, Pa.

[73] Assignee: Control Techtronics, Inc., Harrisburg, Pa.

[21] Appl. No.: 645,337

[22] Filed: Aug. 29, 1984

[51] Int. Cl.[4] ..... F23N 1/02

[52] U.S. Cl. ..... 431/12; 431/90; 431/89

[58] Field of Search ..... 431/12, 18, 76, 80, 431/90, 20, 89; 236/15 BB, 15 BD, 15 E

[56] References Cited

U.S. PATENT DOCUMENTS

| | | | |
|---|---|---|---|
| 2,963,082 | 12/1960 | Binford et al. . | |
| 3,070,149 | 12/1962 | Irwin . | |
| 3,164,201 | 1/1965 | Irwin . | |
| 3,269,448 | 8/1966 | Martin . | |
| 3,602,487 | 8/1971 | Johnson | 431/76 X |
| 3,694,137 | 9/1972 | Ficter et al. . | |
| 3,968,489 | 7/1976 | Richards et al. . | |
| 4,067,684 | 1/1978 | McInerney | 431/12 X |
| 4,097,218 | 1/1978 | Womack . | |
| 4,252,300 | 2/1981 | Herder . | |
| 4,260,363 | 4/1981 | Cratin, Jr. | 431/76 |
| 4,262,843 | 4/1981 | Omori et al. . | |
| 4,264,297 | 4/1981 | Van Berkum . | |
| 4,330,261 | 5/1982 | Sun | 431/76 X |
| 4,334,855 | 6/1982 | Nelson . | |
| 4,362,499 | 12/1982 | Nethery . | |
| 4,375,950 | 3/1983 | Durley, III . | |
| 4,406,611 | 9/1983 | Michel . | |
| 4,411,385 | 10/1983 | Lamkewitz . | |
| 4,421,473 | 12/1983 | Londerville . | |
| 4,436,506 | 3/1984 | Berkhof . | |
| 4,498,363 | 2/1985 | Hanson et al. | 431/90 X |

FOREIGN PATENT DOCUMENTS

| | | |
|---|---|---|
| 50840 | 5/1982 | European Pat. Off. . |
| 88717 | 9/1983 | European Pat. Off. . |
| 54-129531 | 8/1979 | Japan . |
| 848894 | 7/1981 | U.S.S.R. . |
| 909448 | 2/1982 | U.S.S.R. . |

*Primary Examiner*—Randall L. Green

*Attorney, Agent, or Firm*—Sixbey, Friedman & Leedom

[57] ABSTRACT

A flow controller system for optimally controlling the flow of air and fuel to a burner in a plurality of operating modes throughout the firing range of the burner is disclosed herein. The system includes a pair of differential pressure sensors connected across the air conduit and the burner, and the fuel conduit and the burner, as well as a pair of electrically operated air and fuel valves for controlling the pressure of the air and fuel destined for the burner. The system further includes a microprocessor control means electrically connected to both the pressure sensors and the air and fuel pressure regulating valves. Optimal air-to-fuel pressure ratios are empirically derived at each point along the firing range of the burner by means of detachably connectable flowmeters, oxygen sensors and thermocouples, and this information is stored within the memory of the microprocessor control means. The use of a microprocessor control means, in combination with a detachably connectable flowmeter and thermocouple, allows the system to be easily retrofitted onto an existing burner system without the need for installation of orifice plate-type flowmeters.

19 Claims, 4 Drawing Figures

SYSTEM AND PROCESS FOR CONTROLLING THE FLOW OF AIR AND FUEL TO A BURNER

BACKGROUND OF THE INVENTION

1. Field of the Invention

This invention relates to a controller for regulating the air and fuel flow to a burner. The controller utilizes a combustion interface controller having a microprocessor for maintaining the pressure drops of both the air flow and the fuel flow across the burner at desired, optimal rates at each point along the firing range of the burner.

2. Description of the Prior Art

Control systems for regulating the flow of air and fuel to burners and furnaces are well known in the prior art. One of the best known types of these control systems is known as a pressure balanced, constant ratio system. This system operates by balancing the pressures of the air and fuel flow into the burners throughout the firing range of the burners in such a manner that the ratio of the flow rate of the air to the flow rate of the fuel remains at a constant, stoichiometrically optimal value.

Some of the first pressure-balanced ratio systems employed "jack-shafts" which mechanically coupled the air regulating valve and the fuel regulating valve of the system so that when the air valve was set at a different point along the firing range of the burner, the fuel valve automatically mechanically readjusted itself into a position commensurate with the optimal ratio of air flow to fuel flow. Later, mechanical air-to-fuel ratio regulators were developed which worked in conjunction with motor-operated valves in the air conduit. However, such linked valves and mechanical pressure-balanced controls are accompanied by a number of shortcomings. For example, as the mechanical linkage between the air flow and the fuel flow valves wears ad loosens over time, the ability of the system to accurately maintain an optimal air-to-fuel ratio throughout the firing range of the burner diminishes. Similarly, the wear of the diaphragms in the mechanical regulators ultimately impairs the ability of mechanical air-to-fuel ratios to function optimally. Additionally, such mechanical regulators were often inaccurate across every point in the firing range of the burner, even when new. The inaccuracies caused by such wear invariably lead to burning ratios which are less than optimal, and hence fuel-wasting.

To compensate for the inaccuracies which adversely affect such mechanical, pressure balancing controls over time, electronic mass-flow pressure balance controls were developed. These electronic systems generally incorporate flowmeters in both the air and fuel conduits which consist of a calibrated orifice plate mounted in the flowpath of both the air and fuel flows destined for the burner, and a differential pressure sensor which is pneumatically connected across this calibrated orifice plate. The differential pressure sensor transmits an electrical output indicative of the pressure drop across the plate. This electronic output is in turn connected to a microprocessor, which computes the flow rates by calculating the square root of these pressure differential signals. Next, the microprocessor compares these actual air and fuel flow rates with pre-programmed "ideal" optimal ratio set-point rates which have been previously stored in the memory of the microprocessor. The microprocessor then sends signals to motor-operated flow control valves located in both the air and fuel conduits in order to correct any error which it perceives between the actual and set-point air and fuel flows. Some prior art electronic mass-flow pressure balance controls are capable of shifting to a non-stoichiometric "excess air" mode at lower firing rates. Such non-stoichiometric firing rates have been found to increase the heat-producing efficiency of the burner (despite the fact that the resulting air and fuel ratio is not stoichiometrically optimal) because the mixture of excess air and fuel flowing to the burner generates convection currents in the furnace which more effectively and uniformly transfer the heat generated by the burner to the output vent of the furnace.

Despite the superior accuracy that such electronic mass-flow systems have over mechanical-type pressure-balancing systems, certain problems remain. For example, in order for the flowmeters used in such systems to accurately monitor the air and fuel flows destined for the burner, both the inlet and outlet of the orifice plate mounted across the air and fuel conduits must be adjoined to a straight section of conduit at least ten conduit-diameters in length. If such straight lengths of conduit do not adjoin both the inlet and outlet portions of the orifice plate, the flow of the air or fuel through the orifice plate may not have a symmetrical profile across the diameter of the conduit, which in turn will greatly reduce the ability of the flowmeter to relay an accurate flow rate. The requirement that each of the air and fuel sections include a straight section of conduit at least twenty conduit-diameters in length often poses problems when one attempts to retrofit an electronic mass-flow control system onto an older burner. Straight sections having a twenty-diameter length or more may be exist in these older systems, or if they do, such sections may be inaccessible. Hence, the installation of such mass-flow control systems in older burner systems often necessitates the installation of straight sections of conduit in order that the flowmeters necessary for the operation of these systems may function properly. Additionally, the orifice plates of these flowmeters create considerable flow resistances in the air conduit which often necessitates the installation of a new and more powerful air blower which is capable of generating the air flow required at "high fire". Finally, while the accuracy of such electronic mass-flow control systems is generally better than mechanical-type pressure ratio systems, certain inaccuracies are still present even in the best of such systems. Such inaccuracies arise from the fact that the computation of the flow rate is based upon a pressure drop in the air and fuel conduits which is usually considerably upstream of the burner, rather than across the burner itself. Any measured pressure drop upstream of the burner is going to be considerably smaller than the pressure drop across the burner itself. The smaller the pressure drop used to operate the flowmeter, the more difficult it is for the differential pressure sensor to accurately relay differential pressure at the low end of the firing range, which in turn limits the turn-down range of the control system.

Clearly, there is a need for an electronic control system which may be easily retrofitted onto an existing burner system without the necessity of installing straight lengths of conduit in the air or fuel pressure lines, and without replacing the existing blower. Ideally, such a system would be capable of measuring the flow rate of both the air and fuel by accurately measuring the differential pressure drop of the air and fuel across the burner itself, rather than at a point considerably upstream of the burner, in order to extend the potential turn-down range of the system and to reduce the opportunity for inaccurate flow rate measurements to occur. Finally, it would be desirable if such a system was simple and inexpensive in construction, and capable of operating in a hybrid optimum mode consisting of a "splicing together" of various types of optimum modes over the entire firing range of the system.

SUMMARY OF THE INVENTION

In its broadest sense, the invention is a system for controlling the flow of air and fuel to a burner in a variety of operating modes throughout the firing range of the burner in order to maximize fuel efficiency. The system generally comprises a pressure sensing means for sensing the pressure of air flowing into the burner, first and second valves for modulating the flow of air and fuel, respectively, to the burner, and a control means operatively connected to both the first and second valves and the pressure sensing means for maintaining the air-to-fuel pressure ratios at selected optimal values which depend upon the point on the firing range at which the burner is operated.

The pressure sensing means may include first and second differential pressure sensors fluidly connected across the air conduit and the burner, and the fuel conduit and the burner, respectively. In the alternative, when there is a fuel meter present in the fuel conduit which is capable of generating an electricl signal indicative of the flow rate of the fuel, the pressure sensing means may only include a differential pressure sensor connected across the air conduit and the burner. In either case, the pressure sensing means is capable of sensing a pressure drop and generating a signal which is accurately indicative of at least of the flow rate of the air to the burner.

The control means of the invention may be a combustion interface controller which includes a microprocessor. The control means may further be electrically connected to a process controller (which in many cases is merely a programmable thermostat which normally operates the furnace system) and may coact with the combustion interface controller in order that the burner of the system arrives at a desired heat output with a maximum amount of fuel and process efficiency. Both the first and second valves and the output of the differential pressure-sensing means are electrically connected to the combustion interface controller, which is programmed to operate the burner at a specific optimal air-to-fuel pressure ratio at each point along the firing range of the burner. The air-to-fuel pressure ratios may be identical at each point along the firing range of the burner, or they may vary.

The flow controller system may include a flowmeter which is detachably connectable to the fuel conduit for correlating the various fuel pressures along the firing range with specific fuel flow rates. In the preferred embodiment, the flowmeter used is a vortex-shedding flowmeter which is detachably connectable to the fuel conduit by means of a arrangement of T-joints and globe valves. Unlike permanently connected orifice-plate flowmeters, the detachably connected vortex-shedding flowmeters create no efficiency-reducing flow resistances in the fuel conduit. Additionally, because ultrasonic-type flowmeters may be used at the high-pressure sides of the fuel conduits which are typically part of most existing furnace systems, the temporary installation of such flowmeters is usually far simpler than the permanent installation of orifice-plate flowmeters since the amount of straight-length upstream and downstream piping which must be connected to the inlet and outlet of the flowmeter in order to obtain accurate flow readings is much shorter.

After the control system of the invention is initially installed onto an existing furnace system, flow readings are taken from the vortex-shedding flowmeter at selected points along the firing range of the burner. These readings are correlated with the fuel conduit differential pressure readings which correspond to these selected points. Additionally, air flow rates are computed along a series of selected points throughout the firing range of the burner by noting the air pressures at these points, and computing the air flows corresponding to these pressures by means of charts which are usually provided by the blower and burner manufacturers. Both of these sets of data points are read into the microprocessor of the combustion interface controller, which interpolates each of these sets of points into lines correlating specific pressures with specific flow rates of both fuel and air. The system is then calibrated by computing the optimum stoichiometric combinations of air and fuel throughout the entire firing range of the furnace system, and running the system at these computed stoichiometric ratios with an oxygen probe placed in the flue of the furnace in order to empirically correct these ratios to an optimum value at each point along the firing range of the system. Next, the furnace system is run at the empirically derived air-to-fuel ratios at the upper part of the firing range, and at various "excess air" modes at the lower end of the firing range in order to empirically locate the most effective "excess air" mode at the lower end of the firing range. A final "hybrid" optimal mode is then spliced together at the end of these tests and entered into the memory of the microprocessor of the combustion interface controller.

In operation, the process controller compares the actual temperature of the furnace which houses the burners with the desired temperature. If the desired temperature does not equal the actual temperature, the combustion interface controller incrementally adjusts the pressure drops sensed by the differential pressure sensors at a rate dependent upon the perceived difference by adjusting the air and fuel valves until the desired and actual temperatures are equal.

BRIEF DESCRIPTION OF THE SEVERAL FIGURES

DETAILED DESCRIPTION OF THE PREFERRED EMBODIMENT

Structure of the Invention

Figure 1:
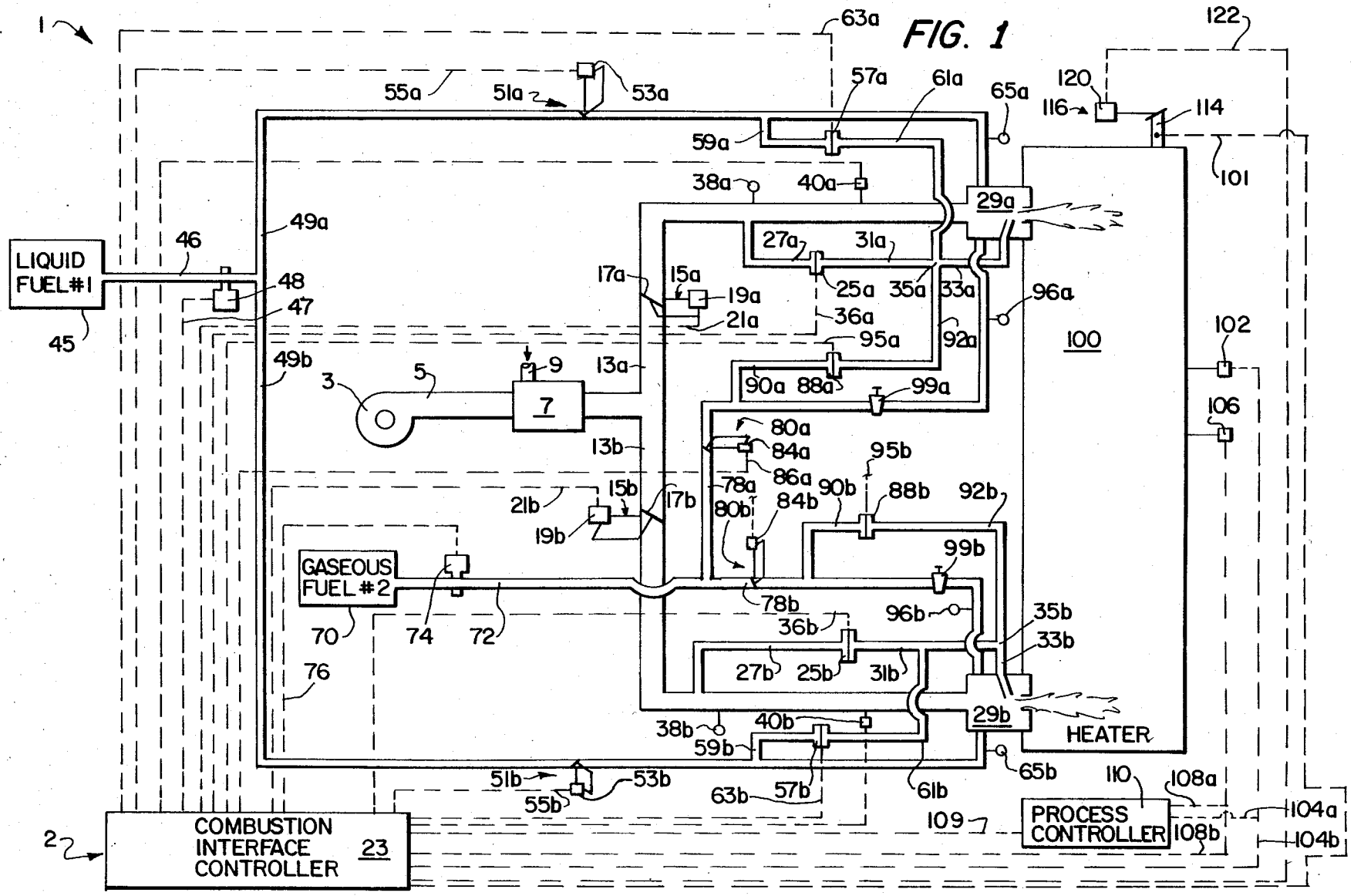
FIG. 1 is a schematic diagram illustrating the control system of the invention retrofitted onto a dual-burner furnace capable of operating on both gaseous and liquid fuels.

FIG. 1 illustrates a preferred embodiment of the control system 1 as installed onto a dual-burner furnace system 2 having a pair of burners 29*a*, 29*b*. Each of the burners 29*a*, 29*b* includes a branch air conduit 13*a*, 13*b*, a liquid fuel branch conduit 49*a*, 49*b*, and a gaseous fuel branch conduit 78*a*, 78*b*, respectively, for guiding a flow of air and liquid or gaseous fuel thereto. Generally, the control system 1 includes six motor-operated valves 15*a*, 15*b*, 51*a*, 51*b*, and 80*a*, 80*b* which are mounted in the air conduits 13*a*, 13*b*, liquid fuel conduits 49*a*, 49*b*, and gaseous fuel conduits 78*a*, 78*b* of the furnace system 2. Each of these valves is electrically connected to the combustion interface controller 23 as indicated.

In the preferred embodiment, the combustion interface controller 23 includes a microprocessor formed by a Z-80 chip manufactured by Zilog, Inc., of Campbell, Calif., which is appropriately connected to a Radio Shack Model TRS-80 microcomputer (black and white version). Radio Shack is a division of Tandy Corporation of Ft. Worth, Tex. The output of the microcomputer is preferably connected to the control cables of the motor-operated valves 15*a*, 15*b*, 51*a*, 52*b* and 80*a*, 80*b* through an appropriate, commercially available interface card.

The control system 2 of the invention further includes six differential pressure sensors 25*a*, 25*b*, 57*a*, 57*b*, and 88*a*, 88*b* which are fluidly connected across the air branch conduits 13*a*, 13*b*, liquid fuel conduits 49*a*, 49*b*, and gaseous fuel conduits 78*a*, 78*b* and the burners 29*a*, 29*b*, respectively. Like the previously discussed motor-operated valves, each of the differential pressure sensors is electrically connected to the combustion interfacecontroller 23.

After the control system 1 has been properly calibrated so that optimal combinations of air and fuel pressure drops have been entered into the memory of the microprocessor of the combustion interface controller 23 for each point along the firing range of the burner assemblies 29*a*, 29*b*, the control system 1 maintains an optimal flow rate of air and fuel at each selected point along the firing range by adjusting the valves 15*a*, 15*b*, 51*a*, 51*b*, and 80*a*, 80*b* until the pressure drops sensed by the differential pressure sensors 25*a*, 25*b*, 57*a*, 57*b*, and 88*a*, 88*b* are achieved. Normally, the air-to-fuel ratio will not remain constant over the entire span of the firing range, but will vary between the low end of the firing range and the medium-to-high ends of this range. At the outset, it should be noted that while the furnace system 2 is capable of operating on either gaseous or liquid fuel, it will normally operate on one fuel or the other, but not both. Accordingly, at any one given time, the combustion interface controller 23 will be controlling either the liquid fuel motor-operated valves 51*a*, 51*b* or the gaseous fuel operated valves 80*a*, 80*b*, but not both simultaneously.

Turning now to a more specific description of the control system 1 in the context of the dual-burner furnace system 2, the air blower 3 of the furnace system 2 is connected to a main blower conduit 5 which preferably includes a heat recuperator 7. The recuperator 7 preheats the pressurized air which the air blower 3 pumps into the burner assemblies 29*a*, 29*b* by reclaiming some of the heat present in the flue gases which escape from the furnace 100. Recuperator 7 preferably includes a flue gas inlet 9 as indicated in order to thermally couple the air flowing through it to the relatively hotter flue gases flowing out of the furnace 100. These flue gases are of course expelled from the recuperator 7 through an appropriate outlet (not shown).

Downstream of the recuperator 7, the main blower conduit 5 bifurcates into branch conduits 13*a*, 13*b*, each of which ultimately communicates with one of the previously mentioned burner assemblies 29*a*, 29*b*. Each of the branch conduits 13*a*, 13*b* includes a motor-operated butterfly valve 15*a*, 15*b*, respectively. Each of these butterfly valves includes a pivotable vent element 17*a*, 17*b* whose position may be modulated by means of an electric motor 19*a*, 19*b*. Each of the electric motors 19*a*, 19*b* are electrically connected to the combustion interface controller 23 by means of output cables 21*a* and 21*b*. Each of the branch conduits 13*a*, 13*b* further includes a differential pressure sensor 25*a*, 25*b* for measuring the differential pressure between the pressurized air in the branch conduits 13*a*, 13*b* and the flame of the burner assemblies 29*a*, 29*b*. Each of these differential pressure sensors 25*a*, 25*b* includes an upstream pressure conduit 27*a*, 27*b* which is pneumatically coupled to its respective branch conduit 13*a*, 13*b* in the position shown, as well as a downstream pressure conduit 31*a*, 31*b* which is pneumatically coupled across the burner assemblies 29*a*, 29*b* through the burner pressure conduits 33*a*, 33*b*, respectively. In the preferred embodiment, differential pressure sensors 25*a*, 25*b* (as well as all of the other differential pressure sensors of the control system 1) may be either the linear-variable differential transformer type as manufactured by Robinson-Halpern of Plymouth Meeting, Pa., or the solid-state piezoresistive silicone chip type (Model PR-270), as manufactured by Manac Systems of Minneapolis, Minn. The electrical outputs of both of the differential pressure sensors 25*a*, 25*b* are connected to the combustion interface controller 23 through input cables 36*a* and 36*b*. Finally, each one of the branch air conduits 13*a*, 13*b* includes both an air pressure gauge 38*a*, 38*b* and a thermocouple 40*a*, 40*b*. The air pressure gauges 38*a*, 38*b* each provide a visual indication of the absolute pressure within the branch conduits 13*a*, 13*b*. Neither of the air pressure gauges 38*a*, 38*b* are necessary for the operation of the control system 1 of the invention. However, the provision of such gauges in each of the branch air conduits 13*a*, 13*b* assists the operator in the initial calibration of the system 1 after it has been installed within a particular burner system 2, and also provides a double-check on the pressure drop readings obtained from the differential pressure sensors 25*a*, 25*b*. The thermocouples 40*a*, 40*b* are each connected to the combustion interface controller 23 via input cables 42*a*, 42*b*, respectively, and generate an electric signal indicative of the temperature of the pressurized air entering the burner assemblies 29*a*, 29*b*. Such temperature readings are important because they provide data which allows the combustion interface controller 23 to infer the density of the air entering the burner assemblies 29*a*, 29*b*, which is necessary if the air flow rate into the burner assemblies is to be accurately computed.

As previously mentioned, the furnace system 2 is capable of burning both liquid and gaseous fuels. Under normal circumstances, the furnace system 2 would burn natural gas. However, in the event that fuel oil should become less expensive than natural gas, or the local utility service should terminate natural gas service to industrial users (as sometimes happens during cold waves in the northeast, when the utility services cannot serve the heating needs of both homeowners and industry), the furnace system 2 is provided with a liquid fuel system as a backup. This liquid fuel system includes a liquid fuel source 45, which is usually fuel oil pressurized by means of a pump. The source 45 of pressurized liquid fuel is fluidly connected to a main liquid fuel conduit 46 which ultimately connects with the burner assemblies 29*a*, 29*b* and includes a means for detachably connecting a flowmeter 48. This flowmeter 48 is part of the flowmeter assembly 180, is best seen with reference to FIG. 3, and will be described in greater detail at a later point in the specification. The flowmeter 48 is connected to the combustion interface controller 23 by means of an input cable 47. Generally speaking, the flowmeter 48 is not a permanent part of the control system 1 of the invention, but is detachably connected to the main liquid fuel conduit 46 for calibration purposes only, whereupon it is removed. The flowmeter 48 is used to empirically ascertain the liquid fuel flow rates which correspond to each value of the liquid fuel differential pressures along the firing range of the burner assemblies 29*a*, 29*b*. In the preferred embodiment, flowmeter 48 is a Model VTX 900 vortex-shedding ultrasonic flowmeter manufactured by Brooks Instrument Division of Emerson Electric Company located in Hatfield, Pa. The use of a detachably connectable ultrasonic flowmeter on the main liquid fuel conduit 46 provides the combustion interface controller 23 with an accurate correlation between actual liquid fuel flow rates and liquid fuel pressures across the entire operating range of the burner system 2 without the need for a permanently installed flowmeter, which not only introduces unwanted obstructions in the flowpath of the fuel, but is often expensive to install.

Downstream of the flowmeter 48, the main liquid fuel conduit 46 bifurcates into two branch fuel conduits 49*a* and 49*b*. Each of the branch fuel conduits 49*a*, 49*b* includes a motor-operated fuel valve 51*a*, 51*b* which in turn includes its own valve motor 53*a*, 53*b* for modulating the flow of fuel through these valves. Each of the motor-operated flow valves 51*a*, 51*b* is connected to the combustion interface controller 23 by way of an output control cable 55*a* and 55*b*, as indicated in FIG. 1. In addition to the valves 51*a*, 51*b*, each of the liquid fuel branch conduits 49*a*, 49*b* includes its own differential pressure sensor 57*a*, 57*b* for ascertaining the differential pressure of the liquid fuel across the burner assemblies 29*a*, 29*b*, respectively. Each of the differential pressure sensors 57*a*, 57*b* includes upstream pressure conduits 59*a*, 59*b* which are directly connected to the liquid fuel branch conduits 49*a*, 49*b*, and downstream pressure conduits 61*a*, 61*b* which are connected to the burner pressure conduits 33*a*, 33*b* by way of pneumatic intersections 35*a*, 35*b*. As was the case with the differential pressure sensors 25*a*, 25*b* located on the air branch conduits 13*a*, 13*b*, the output of each of the differential pressure sensors 57*a*, 57*b* is connected to the combustion interface controller 23 by means of an input cable 63*a*, 63*b*. Finally, each of the liquid fuel branch conduits 49*a*, 49*b* includes its own pressure gauge 65*a*, 65*b*. Each of these gauges serves the same function as the air pressure gauges 38*a*, 38*b* serve with respect to their branch conduits 13*a*, 13*b*, i.e., they facilitate the initial calibration of the system 1 and assist in detecting spurious readings of the differential pressure sensors 57*a*, 57*b* in the event either of these sensors malfunctions.

Turning now to the components of the gaseous fuel system of the furnace system 2, a source 70 of pressurized gaseous fuel (which is typically natural gas) is connected to the burner assemblies 29*a*, 29*b* via a main gaseous fuel conduit 72. Like the previously-described main liquid fuel conduit 46, conduit 72 likewise includes means for detachably connecting a flowmeter 74, which is also a vortex shedding ultrasonic flowmeter. However, in contrast to the Brooks Instruments ultrasonic flowmeter used in connection with the liquid fuel source 45, flowmeter 74 is preferably a VP series, gaseous-type vortex-shedding ultrasonic flowmeter manufactured by J-Tec Associates, Inc. of Cedar Rapids, Iowa. The use of a detachably connectable ultrasonic flowmeter 74 in gaseous fuel conduit 72 obviates the installation of an expensive orifice plate flowmeter, which could require the permanent installation of a straight length of conduit over twenty diameters in length. Additionally, the use of an ultrasonic flowmeter 74 in the gaseous fuel conduit 72 has the effect of extending the firing ratio of the furnace 2, since such flowmeters are sensitive over a much greater range than orifice-plate flowmeters. As is indicated in FIG. 1, flowmeter 74 is electrically connected to the combustion interface controller 23 by means of an input control cable 76. The main gaseous fuel bifurcates into a pair of gaseous fuel branch conduits 78*a*, 78*b*. Each of the branch conduits 78*a*, 78*b* includes a motor-operated, butterfly-type valve 80*a*, 80*b* which is modulated by means of an electric motor 84*a*, 84*b*, respectively. Each of these motor-operated valves 80*a*, 80*b* is connected to an output cable 86*a*, 86*b* connected to the combustion interface controller 23. In addition to having its own motor-operated butterfly-type valve, each of the gaseous fuel branch conduits 78*a*, 78*b* further includes its own differential pressure sensor 88*a*, 88*b* for generating an electric signal indicative of the differential pressure drop across the gaseous fuel in the branch conduits 78*a*, 78*b* and the flame in the burner assemblies 29*a*, 29*b*. To this end, each of the sensors 88*a*, 88*b* includes an upstream pressure conduit 90*a*, 90*b* connected to its respective gaseous fuel branch conduit 78*a*, 78*b*, and a downstream pressure conduit 92*a*, 92*b* connected to the burner pressure conduits 33*a*, 33*b* via pneumatic intersections 35*a*, 35*b*, as shown in FIG. 1. The outputs of each of the gaseous fuel pressure differential sensors 88*a*, 88*b* are connected to the input of the combustion interface controller 23 by way of input cables 95*a*, 95*b*. Finally, in order that the fluid resistance of each of the gaseous fuel branch conduits 78*a*, 78*b* may be equalized, each of these branches includes a trim valve 99*a*, 99*b*.

The furnace system 2 includes a heater 100 for housing the previously mentioned burner assemblies 29*a*, 29*b*. A pair of thermocouples 102 and 106 are thermally coupled to the interior of the heater 100. These thermocouples 102 and 106 transmit electrical signals indicative of the temperature of different regions of the heater 100 to both the process controller 110 and the combustion interface controller 23 by way of parallel-connected input cables 104*a*, 104*b* and 108*a*, 108*b*, respectively. The output of the process controller 110 (which may be a pair of commercially available, programmable thermostatic controls) is in turn connected to the input of the combustion interface controller 23 by means of an input cable 109. The process controller 110 senses the difference between the actual temperature within the furnace 100 and the desired temperature to which the control system 1 is set, and transmits an electrical signal indicative of this difference in temperature to the combustion interface controller 23 by way of cable 109. If the process controller 110 includes a pair of thermostatic controls wired in parallel to the outputs of each of the thermocouples 102 and 106, the control system 2 will have the capacity to maintain different regions of the furnace 100 at different temperatures by modulating the motor-operated valves 15*a*, 15*b* and 84*a*, 84*b* (or 51*a*, 51*b* if the furnace 2 employs liquid fuel), so that the burners 29*a*, 29*b* burn air and fuel at different pressure ratios. Such a capacity would allow the control system 1 to operate the burners 29*a*, 29*b* in either a multiplexed or a cascade mode, thereby enhancing the overall fuel performance of the control system 1. If the process controller 110 includes only one programmable thermostatic control, the thermocouple which is not connected to the thermostatic control of the process controller 110 may be tied into an optional alarm circuit in the combustion interface controller 23 which is programmed to actuate when the temperature in the heater 100 exceeds a preselected temperature for a preselected amount of time. Process controller 110 is preferably formed from one or two Model 570 thermostatic controls manufactured by Barber Coleman Company of Loves Park, Ill. The heater 100 further includes a flue duct 114 having a motor-operated flue valve 116. The motor 120 of the flue valve 116 is connected to the output of the interface combustion interface controller 23 by means of output cable 122 as indicated. The motor-operated flue vent valve 116 adjusts the heater pressure to maintain a desired pressure difference between the interior of the heater 100 and the ambient atmosphere. The combustion interface controller 23 maintains this desired pressure by means of a differential pressure sensor (not shown) which is pneumatically connected between the burner 100 and the ambient atmosphere, and electrically connected to the controller 23.

Figure 2:
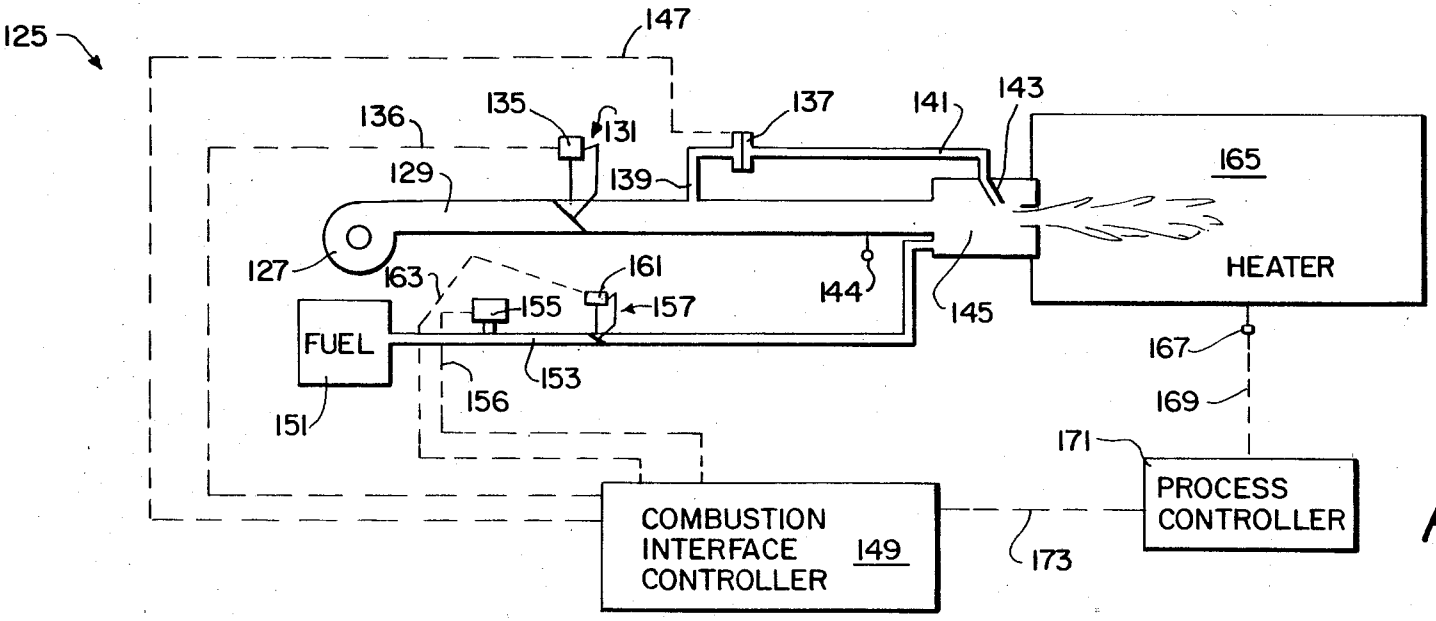
FIG. 2 is an alternate embodiment of the control system of the invention retrofitted onto a furnace having a single, gaseous fuel burner and a fuel meter on its fuel conduit.

FIG. 2 illustrates an alternate embodiment 125 of the control system of the invention for use in furnace systems 126 which already include a fuel meter 155. Generally speaking, this alternate embodiment 125 includes a motor-operated butterfly valve 131 which is electrically connected to the output of a combustion interface controller 149 of the same type as the controller 23 previously described. Also included is a differential pressure sensor 137 which is pneumatically connected across the blower conduit 129 and the burner assembly 145, and electrically connected to the input of the combustion interface controller 149. The presence of previously installed fuel meter 155 (whose output is electrically connected to the input of the combustion interface controller 149) obviates the need for a differential pressure sensor across the fuel conduit 153, as will become more evident shortly.

Turning now to a more specific description of the alternate embodiment 125 of the control system within the context of a furnace 126 having its own fuel meter 155, the furnace system 126 includes a blower 127 which is pneumatically connected to blower conduit 129 as indicated. The blower conduit 129 includes the previously mentioned motor-operated butterfly valve 131. This valve 131 includes a motor 135 for changing the angle of a pivoting valve element contained within the blower conduit 129. The motor 135 of the butterfly valve 131 is electrically connected to the output of the combustion interface controller 149 by means of a cable 136. Blower conduit 129 further includes a differential pressure sensor 137 for sensing the pressure of the air in the blower conduit 129 across the burner assembly 145. An upstream pressure conduit 139 pneumatically connects one side of the pressure sensor 137 with the blower conduit 129. A downstream pressure conduit 141 pneumatically connects the other side of the differential pressure sensor 137 with a burner pressure conduit 143 which is pneumatically coupled to the flame region of the burner assembly 145. The differential pressure sensor 137 is electrically connected to the input of the combustion interface controller 149 by means of an input cable 147.

The fuel system of the furnace 126 includes a source 151 of pressurized fuel, which is preferably natural gas. Fuel source 151 is pneumatically connected to the input of the burner assembly 145 by means of a fuel conduit 153. The fuel conduit 153 includes the previously mentioned fuel meter 155, which is electrically connected to the input of the combustion interface controller 149 by means of input cable 156. The fuel meter 155 may be any one of a number of commercially available fuel meters capable of generating an electric signal indicative of the flow rate of fuel passing through the fuel conduit 153. Downstream of the fuel meter 155 is a motor-operated butterfly valve 157 for controlling the flow of fuel into the burner assembly 145. Valve 157 includes a motor 161 which is electrically connected to the output of the combustion interface controller 149 by means of output cable 163. Finally, the furnace system 126 includes a heater 165 which houses the burner assembly 145. The heater 165 includes a thermocouple 167 which is connected to a process controller 171 (of the same type as process controller 110 of FIG. 1) by means of an input cable 169. The output of the process controller 171 (which is generally an electrical signal indicative of the difference between the desired and actual temperatures in the heater 165) is in turn connected to the combustion interface controller 149 by means of cable 173.

Figure 3:
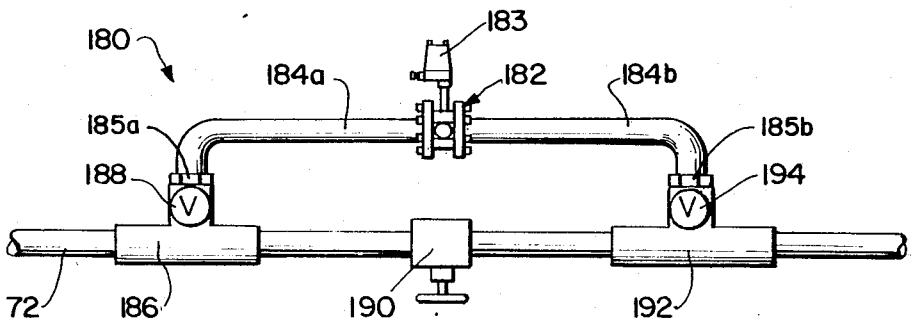
FIG. 3 is a side view of the detachably mountable flowmeters used to calibrate the control system of the invention, illustrating both the flowmeter, fittings and conduits used to temporarily connect it to the high pressure side of a fuel conduit.

FIG. 3 illustrates the detachably connectable flowmeter assembly 180 of the invention. As previously described, the ultrasonic flowmeter 182 of this assembly 180, having a visual readout 183, is preferably a Brooks or J-Tec vortex-shedding ultrasonic flowmeter, depending upon whether the assembly 180 is to be used on liquid fuel conduit 46 or gaseous fuel conduit 72. The upstream and downstream sides of the flowmeter 182 are coupled to U-shaped tube sections 184*a* and 184*b*. Each of these U-shaped tube sections terminates in a fitting 185*a*, 185*b*. These fittings are detachably connectable to T-joints 186 and 192 which are specially mounted onto the fuel conduits 46, 72 and 153 as part of the process of installing the control system of the invention onto the furnace systems 2 and 126 illustrated in FIGS. 1 and 2, respectively. Fittings 185*a*, 185*b* may be either standard screw-type fittings, or commercially available quick-disconnect fittings. Each of the T-fittings 186, 192 includes a ball-type shutoff valve 188, 194 for shunting the flow of gaseous fuel from the fuel conduit to the U-shaped tube sections 184*a*, 184*b*. Additionally, another ball-type valve 190 is provided in the fuel conduit between the two T-joints 186 and 192 to insure that all of the fuel flowing through the fuel conduit will be shunted around the U-shaped tube sections 184*a*, 184*b* when the valves 188 and 194 of the T-joints 186 and 192 are opened.

Operation of the Invention

A. Installation and Calibration

With reference now to FIGS. 1 and 3, the first step of the installation and calibration process of the invention is the installation of the detachably connectable flowmeter assembly 180 onto the fuel conduit 72. Such installation is preferably done by closing off a shutoff valve (not shown) which is located upstream of the installation site, and installing the T-joints 186, 192 and the valve 190 in the conduit 72 in a conventional manner with pipe cutting and pipe threading tools. In heating systems which utilize natural gas, the flowmeter assembly 180 is advantageously connected onto the high-pressure side of the fuel conduit 72 at a point upstream of the pressure regulator (not shown) which is usually present in natural gas-burning systems. The installation of the flowmeter assembly 180 at a point on the high-pressure side of the fuel conduit 72 allows the use of relatively short U-shaped tube sections 184*a*, 184*b*, which in turn facilitates the process of installing the flowmeter assembly 180 onto the fuel conduit 72. Relatively short U-shaped tube sections 184*a*, 184*b* may be used at this juncture in the conduit 72 because the high-pressure side of the conduit 72 frequently utilizes relatively small diameter piping. The ultrasonic flowmeter 182 requires at least ten diameters of straight piping on both its upstream and downstream sides. As previously mentioned, the diameter of the piping forming the U-shaped tube sections 184*a*, 184*b* must be the same diameter as the conduit into which it is installed; accordingly, the installation of the flowmeter assembly 180 at a point where the fuel conduit 72 is at its minimum diameter minimizes the ten-diameter or fifteen-diameter length of the U-shaped tube sections 184*a*, 184*b*. It should be noted that, if desired, the U-shaped tube sections 184*a*, 184*b* may be mounted across a relatively convoluted section of pipe, since the ultrasonic flowmeter 182 will only "see" the fuel which is shunted through the assembly 180.

In the next step of the installation process, the differential pressure sensors 25*a*, 25*b*, 57*a*, 57*b* and 88*a* and 88*b* are mounted in the air conduits 13*a*, 13*b*, liquid fuel conduits 49*a*, 49*b* and gaseous fuel conduits 78*a*, 78*b*, respectively. Similarly, the installation of the control system 125 in the furnace system 126 illustrated in FIG. 2 is completed by pneumatically connecting the differential pressure 137 in the blower conduit 129. Motor-operated air and fuel valves are typically already present in furnace systems 2 and 126; however, if they are not, appropriate, commercially available motor-operated valves should be installed in all of the branch air and fuel conduits of the furnace systems 2 and 126. The installation of the control systems 2 and 126 is completed when the air and fuel motor-operated valves, the differential pressure sensors, thermocouples and process controllers are electrically connected to the combustion interface controllers 23 and 149, respectively.

Turning now to the procedure used to calibrate the control system 2, the operator of the system 2 first actuates the air blower 3, and ignites the burner assemblies 29*a*, 29*b* in a conventional manner. Next, the operator correlates gaseous fuel flow rates, air flow rates and liquid fuel flow rates with the air and fuel differential pressure readings provided by differential pressure sensors 88*a*, 88*b*, 25*a*, 25*b* and 57*a*, 57*b* at selected points across the entire firing range of the burner assemblies 29*a*, 29*b*.

With respect to gaseous fuel flow rates, the operator correlates specific fuel flow rates with the differential pressure drops sensed by the gaseous fuel differential pressure sensors 88*a*, 88*b* across the entire operating span of the burner assembly 2 by visually monitoring the readout display 183 of the detachably connectable ultrasonic flowmeter 182. The gaseous flow rates corresponding to the differential pressures sampled at selected points across the operating range of the burners 29*a*, 29*b* are then fed into the combustion interface controller 23, which is programmed to interpolate these sample points into a line which associates a specific gaseous fuel flow rate with each differential pressure reading taken across the fuel conduit 72 from low fire to high fire.

In the next step of the cablibration procedure, the air flow rates are computed on the basis of the pressure drop readings of the differential pressure sensors 25*a*, 25*b*. While it would be possible to compute the air flow rate with a detachably connectable ultrasonic flowmeter in the same way that the gaseous fuel rate is computed, such an arrangement is not necessary in view of the fact that air blower and burner manufacturers generally provide a chart which specifies the air flow rates associated with the pressure readings taken at selected points of blower output. Once the air flow rates have been correlated with various differential pressure drops across the burners 29*a*, 29*b* at selected operating points, this data is entered into the combustion interface controller 23, which again interpolates these values into a line which associates a specific air flow rate with each differential pressure drop across the entire firing range of the system 2. An alternative procedure would be to use the readings obtained by pressure gauges 38*a* and 38*b* located on branch air conduits 13*a*, 13*b*. However, this procedure is not preferred in view of the greater accuracy which can be attained through the use of the differential pressure sensors 25*a*, 25*b* which measure the pressure drop directly across the burners 29*a*, 29*b*, rather than between the air in the branch conduits 13*a*, 13*b* and the ambient atmosphere.

Once the correlations between the air flow rate and the differential pressures in the air branch conduits 13*a*, 13*b* have been obtained and entered into the combustion interface controller 23, the same calibration process which was used with respect to the gaseous fuel system is repeated with respect to the liquid fuel system. Of course, a gaseous rather than a liquid ultrasonic flowmeter 182 will have to be used, along with U-shaped tube sections 184*a*, 184*b* of different diameters, if the diameter of the liquid fuel conduit 46 is different from that of the high pressure side of the gaseous fuel conduit 72.

Once the gaseous fuel flow rate, the air flow rate and the liquid fuel flow rate have been correlated to differential pressure readings in the manner previously described, the optimum operating mode of the combustion interface controller 23 is determined by means of a four-step process. In the first step of this process, the air and fuel differential pressures corresponding to the optimum stoichiometric air-to-fuel ratios are computed for each point in the firing range of the burner assembly 2. Next, the burner assemblies 29*a*, 29*b* are burned at these computed optimum ratios throughout the firing range of the system 2 while the oxygen content of the flue gas is monitored by means of an oxygen probe 101 which is detachably connected to the flue of the furnace 100. These optimum computed ratios are corrected at regions in the operating range where the oxygen probe indicates that an excess amount of oxygen (i.e., between 1% and 5%, depending upon the type of burner) is present in the flue gas, which indicates that incomplete, and hence inefficient, combustion is taking place. In the third step of the process, the furnace system can be operated at various "excess air" modes at the low end of the firing range of the system 2 while the heat output of the system 2 is monitored by means of heater thermocouples 102 and 106. The particular "excess air" mode which results in the most efficient use of fuel is noted. In the final step of this process, an optimum operating mode is constructed by "splicing" together the various differential air and fuel pressures which result in the maximum amount of heat output per unit of fuel for every point in the firing range of the furance system 2. In most instances, the optimum operating mode will be a hybrid mode which utilizes variable air-to-fuel ratios which are substantially optimally stoichiometric at the "high fire" end of the firing range, but which become more and more "excess air" biased as one approaches the "low-fire" end of the operating range. This hybrid mode is entered into the memory of the microprocessor in the combustion interface controller 23. In any system utilizing more than one burner assembly, the optimum mode may further include empirically determined instructions for the multiplexing or pulse-firing of the burner assemblies 29*a*, 29*b* in order to further maximize the heating efficiency of the furnace system 2 across the firing range of the system. In closing, it should be noted that the installation and calibration procedures for the alternate control system 125 are eventually the same as for the control system 1.

B. Operation of the Invention

Figure 4:
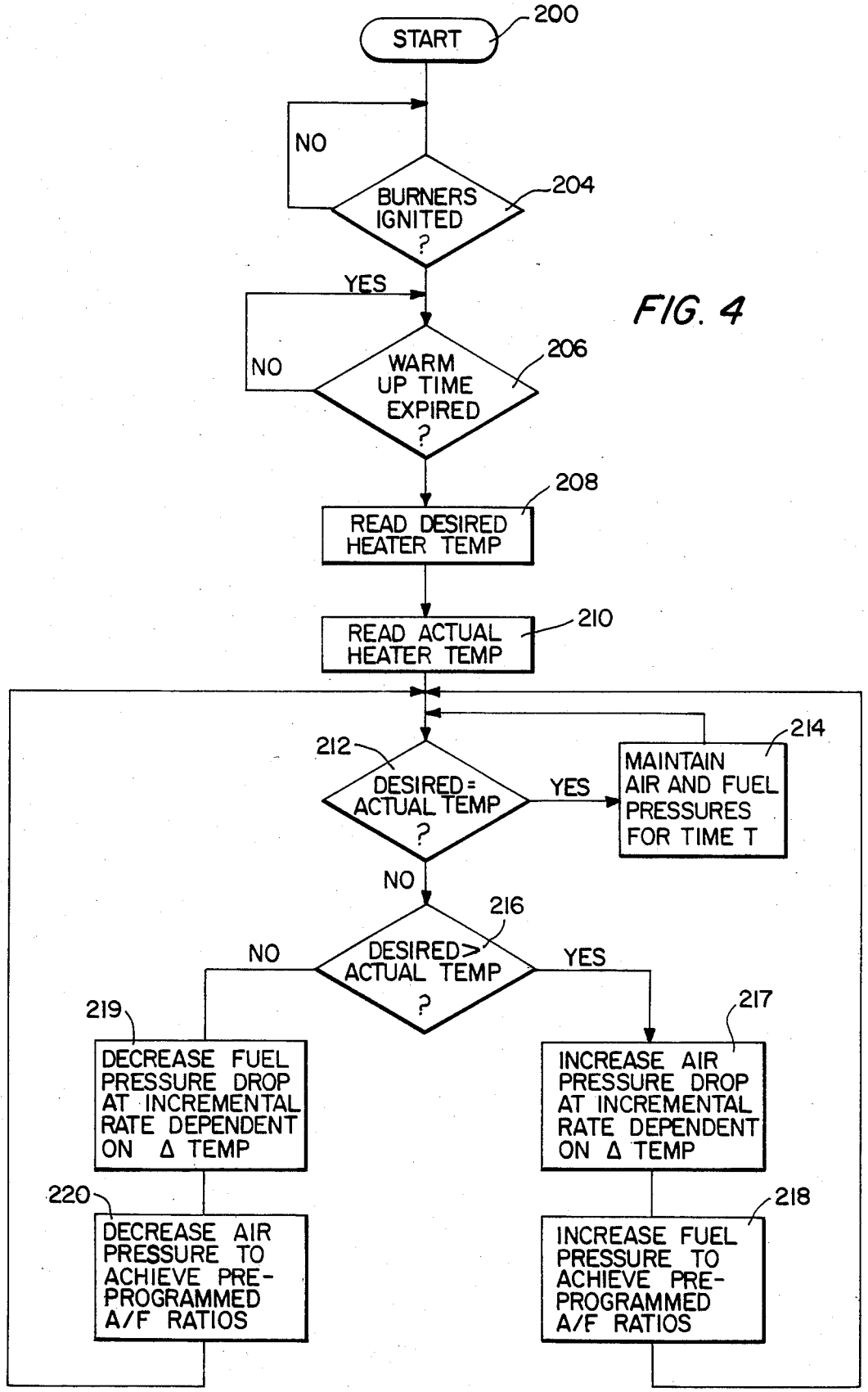
FIG. 4 is a flow chart illustrating the operation of the combustion interface controller of the system.

FIG. 4 is a flow chart which generally illustrates the program by which the combustion interface controllers 23 and 149 operate their respective furnace systems 2 and 126 in conjunction with their respective process controllers 110 and 171. Because the operating mode is essentially identical in both embodiments, the following description will refer to only the control system 1 illustrated in FIG. 1.

After the program starts at block 200, the burners 29*a*, 29*b* are ignited as indicated in block 202. At this juncture of the program, the combustion interface controller 23 inquires whether or not the burners 29*a*, 29*b* are ignited in question block 202 while periodically monitoring the readings of the heater thermocouples 102 and 106. Once the combustion interface controller 23 receives a signal from these thermocouples which indicate that the burners 29*a*, 29*b* have indeed ignited, it immediately begins to count down a ten-minute warmup interval. As indicated in inquiry block 206, it periodically inquires whether or not the ten-minute warmup interval has expired. In the meantime, the process controller 110, which is working in conjunction with the combustion interface controller 23, is proceeding through operation blocks 208 and 210, and generating a signal indicative of the difference between the desired temperature and the actual temperature in the heater 100. Although not expressly indicated in the flow chart in FIG. 4, the comparison operation indicated by blocks 208 and 210 is repeated at short time intervals so that the process controller 110 constantly transmits a signal via cable 109 to the process interface controller which indicates the difference between the desired and actual heater temperature.

As soon as the warm-up time expires and the answer to this inquiry block 206 is affirmative, the combustion interface controller 23 proceeds to inquiry block 212, reads the signal transmitted to it from the process controller 110, and inquires, in question block 212, whether the desired heater temperature equals the actual heater temperature. If the answer to this inquiry is affirmative, it maintains the air and fuel pressure drops it is currently sensing from the air differential pressure sensors 25*a*, 25*b* and gaseous fuel differential pressure sensors 88*a*, 88*b* (or liquid differential pressure sensors 51*a*, 51*b*) by making no adjustments in the positions of the valve elements of the motor-operated air and fuel valves 15*a*, 15*b* and 80, 80*b* (or liquid pressure sensors 51*a*, 51*b*, depending upon whether or not the furnace system 2 is running off the gaseous fuel source 70 or the liquid fuel source 45). However, if the answer to this inquiry is negative, the controller proceeds to inquiry block 216, and asks itself whether or not the desired heater temperature is greater than the actual heater temperature.

If the answer to the question in inquiry block 216 is affirmative, the microprocessor of the controller 23 proceeds to operating block 217 and increases the differential air pressure by incrementally opening both the motor-operated air valves 15*a*, 15*b*. The microprocessor of the combustion interface controller 23 is programmed so that the rate of these incremental changes in the position of the air valves 15*a*, 15*b* is proportional to the difference between the desired and actual temperatures in the heater 100 in order to minimize "hunting". After each incremental opening of the air valves, the controller 23 incrementally opens the gaseous fuel valves 80*a*, 80*b* enough to achieve the correlating differential fuel pressure which has been preprogrammed into the memory of the microcomputer of the controller 23 as part of the optimum mode of operation. After opening the gaseous fuel valves 80*a*, 80*b* enough to achieve this desired correlating differential fuel pressure, the microprocessor of the controller 23 reinquires whether or not the desired temperature of the heater 100 equals the actual temperature of the heater 100, and repeats the cycle represented by inquiry blocks 212, 216 and operational blocks 217, 218 until the desired temperature and the actual temperature are equivalent.

If the answer to the question in the inquiry block 216 is negative, the microprocessor of the combustion interface controller 23 proceeds to operating block 219, and incrementally decreases the differential pressure of the fuel across the burners 29*a*, 29*b* by incrementally closing the fuel valves 80*a*, 80*b* (or 51*a*, 51*b*) again at a rate which is dependent upon the difference between the desired and actual temperatures within the burner 100. Each incremental decrease in the differential fuel pressure is followed by an incremental decrease in the differential air pressure, which is implemented by incrementally moving the valve elements of the air valves 15*a*, 15*b* toward a closed position. Again, the incremental decreases in the differential air pressure are chosen so that the burners 29*a*, 29*b* of the furnace system 2 are operated in accordance with a pre-programmed optimum mode. It should be noted that the initial opening-up of the air valves 15*a*, 15*b* in an under-temperature condition, and the initial closing-down of the fuel valves 80*a*, 80*b* in an over-temperature condition prevents a fuel-wasting, over-rich mixture of air and fuel from burning in the burner assemblies 29*a*, 29*b* throughout any portion of the operating cycle of the furnace system 2.

After the microprocessor of the combustion interface controller 23 completes blocks 218 and 220, it continually loops back around the inquiry block 212, and from there back through blocks 217 and 218, or 219 and 220, until the answer to the question in inquiry block 212 is affirmative, whereupon it proceeds to block 214 and maintains the arrived-at air and fuel differential pressures in the manner heretofore described.

To compensate for the small amount of overshooting which may occur in the control system 2, the microprocessor of the combution interface controller 23 continues to periodically inquire whether or not the desired temperature equals the actual temperature in the heater 100, even after this question has been answered in the affirmative, in order to determine whether or not the achievement of the desired temperature was merely a transitory state within the heater 100. If the achievement of the desired temperature was transistory, it will be appreciated that the sequence of steps represented by inquiry and operation blocks 212 through 220 will be repeated until the differential air and fuel pressures arrive at stable values capable of maintaining the desired temperature within the heater 100.

In closing, it should be noted that use of vortex-shedding ultrasonic flowmeters 182 in an optimal mode which utilizes excess air provides a control system capable of a 30:1 firing range, as compared to the 8:1 firing ranges typically available in prior art systems.

Although the present invention has been described with reference to a preferred embodiment, it should be understood that the invention is not limited to the details thereof. A number of possible substitutions and modifications have been suggested in the foregoing detailed description, and others will occur to those of ordinary skill in the art. All such substitutions and modifications are intended to fall within the scope of the invention as defined in the appended claims.

What is claimed is:

1. A flow controller system capable of controlling the flow of air and fuel to a burner in a plurality of operating modes throughout the firing range of the burner, wherein said air and fuel are conducted to said burner by separate conduits fluidly connected to said burner, comprising:

(a) an air flow indicating means including a differential pressure sensing means fluidly connected across the air conduit and the burner for sensing the pressure drop of the air flow across the burner and generating a signal indicative of the rate of air flow into the burner;

(b) first and second valves for modulating the flow of air and fuel, respectively, to the burner which are fluidly connected upstream of the air flow indicating means;

(c) a fuel flow indicating means for generating a signal indicative of the rate of fuel flow into the burner, and (d) a control means operatively and separately connected to both the first and second valves and the fuel and air flow indicating means for maintaining selected air and fuel flow rates throughout the firing range of the burner by comparison with precalibrated air and fuel flow ratios, wherein said control means is adjustable at all points throughout the firing range of the burner.

2. The flow controller system of claim 1, wherein the fuel flow indicating means includes a second differential pressure sensor fluidly connected across the fuel conduit and the burner.

3. The flow controller system of claim 1, wherein said control means is a combustion interface controller including a microprocessor having a memory, and wherein said first and second valves are electrically operated.

4. The flow controller system of claim 3, further including a flowmeter which is detachably connectable to the fuel conduit for providing a correlation between fuel flow rate and fuel flow differential pressure over a plurality of points throughout the firing range of the burner which may be entered into the memory of the microprocessor and used to compute optimal air-to-fuel pressure ratios.

5. The flow controller system of claim 4, wherein said flowmeter is a vortex-shedding, ultrasonic-type flowmeter.

6. The flow controller system of claim 4, wherein said flowmeter produces no more than a one pound pressure drop in the flow of fuel destined for the burner.

7. The flow controller system of claim 4, wherein said flowmeter is detachably connectable to the fuel conduit by means of a quick-disconnect type coupling.

8. The flow controller system of claim 3, wherein the burner is connected to a flue, and further including an oxygen probe which is detachably connectable with the flue for assisting the operator of the microprocessor in empirically determining the optimal air-to-fuel pressure ratios throughout the firing range of the burner.

9. The flow controller system of claim 3, further including a thermocouple thermally coupled to the output of the burner for assisting the operator of the microprocessor in empirically determining the optimal air-to-fuel pressure ratios throughout the firing range of the burner.

10. A flow controller system for a burner capable of controlling the flow of air and fuel cccthrough separate conduits to said burner in a plurality of operating modes throughout the firing range of the burner, comprising:

(a) an air flow and a fuel flow indicating means including a first pressure sensing means fluidly connected across the air conduit and the burner, and a second pressure sensing means fluidly connected across the fuel conduit and the burner for generating electrical signals indicative of the pressure differential between the air conduit and fuel conduit and the burner, respectively;

(b) first and second electrically operative valves for modulating the flow of air and fuel, respectively, to the burner, and (c) a combustion interface controller including microprocessor control means electrically and separately connected to said air flow and fuel flow indicating means and said first and second valves for maintaining a plurality of preselected optimal ratios between the differential air pressure and the differential fuel pressure throughout the firing range of the burner by modulating said valves until the measured differential pressures equal the optimal differential pressures, wherein said first and second pressuring sensing means are fluidly connected downstream of said first and second air and fuel valves.

11. The flow controller system of claim 10, further including a flowmeter which is detachably connectable to the fuel conduit for providing a correlation between fuel flow rate and the differential pressure between the fuel flow in the fuel conduit and the burner over a plurality of points throughout the firing range of the burner which may be entered into the memory of the microprocessor and used to compute optimal air-to-fuel pressure ratios.

12. The flow controller system of claim 11, wherein said flowmeter produces no more than a one-pound pressure drop in the flow of fuel destined for the burner.

13. The flow controller system of claim 11, wherein said flowmeter is a vortex-shedding, ultrasonic-type flowmeter.

14. The flow controller system of claim 10, wherein the burner includes a flue, and further including an oxygen probe which is detachably connectable with the flue for assisting the operator of the microprocessor in empirically determining the optimal air-to-fuel pressure ratios throughout the firing range of the burner.

15. The flow controller system of claim 10, further including a thermocouple thermally coupled to the output of the burner for assisting the operator of the microprocessor in empirically determining the optimal air-to-fuel pressure ratios throughout the firing range of the burner.

16. A process for optimally operating and air and fuel regulating system for a burner having first and second pressure regulating valves for controlling the air and fuel flow to the burner, first and second pressure sensors for sensing the differential pressure of the air flow and the fuel flow, respectively, across the burner, wherein said sensors are fluidly connected downstream of said first and second valves, and a combustion interface controller including a microprocessor having an input which is electrically connected to the first and second differential pressure sensors and an output which is connected to first and second pressure regulating valves, comprising the steps of:

(a) deriving an optimal set of air and fuel flow rates by measuring the optimal differential pressures of the air flow and the fuel flow across the burner, respectively, for each point across the firing range of the burner;

(b) entering the optimal air and fuel differential pressures derived at step (a) into the microprocessor, and (c) electrically adjusting the position of air flow and fuel flow valves by means of the microprocessor for any selected point on the firing range until the pressures sensed by the differential air and fuel flow sensors are equal to the optimal differential air and fuel flow pressures entered into the memory of the microprocessor for that particular point on the firing range.

17. The process of claim 16, wherein said burner is housed in a heaer, and further including the steps of:

(d) selecting a desired temperature for the heater;

(e) sensing the actual temperature of the heater, and (f) electrically adjusting the positions of the air and fuel flow valves until the actual temperature of the heater equals the desired temperature of the heater.

18. The process of claim 17, wherein the rate of electrically adjusting the positions of the air and fuel flow valves is dependent upon the difference between the actual and desired temperature of the heater.

19. A process for optimally operating an air and fuel regulating system for a burner having first and second pressure regulating valves for controlling the air and fuel flow to the burner, first and second pressure differential sensors for sensing the differential pressure of the air flow and the fuel flow, respectively, across the burner, wherein said sensors are fluidly connected downstream of said first and second valves, and a combustion interface controller including a microprocessor having an input which is electrically connected to the first and second differential pressure sensors and an output which is connected to first and second pressure regulating valves, comprising the steps of:

(a) igniting the burner;

(b) recording the differential pressure of the air flow across the burner at a plurality of related points along the firing range of the burner;

(c) correlating the differential pressures obtained in step (b) with air flow rates;

(d) detachably connecting a flowmeter across the fuel flow of the system;

(e) recording the differential pressure of the fuel flow across the burner at a plurality of selected points along the firing range of the burner;

(f) recording the flow rate indicated by the flowmeter at each of the plurality of selected points in order to correlate a fuel flow rate with fuel flow differential pressure;

(g) interpolating both the recorded values of the air flow differential pressures and their corresponding air flow rates across the firing range of the burner;

(h) interpolating both the recorded values of the fuel flow differential pressures and their corresponding fuel flow rates across the firing range of the burner;

(i) computing the air and fuel differential pressures at each point along the firing range of the burner which corresponds to the stoichiometrically optimal air-to-fuel ratio;

(j) operating the burner across its entire firing range at the air and fuel differential pressure derived at step (i) while monitoring the resulting flue gases with an oxygen probe;

(k) adjusting the air and fuel differential pressures at all points in the firing range where the oxygen probe indicates a state of inefficient combustion;

(l) operating the burner across the lower half of its firing range in a plurality of excess air modes while recording the heat output of the burner;

(m) deriving an optimal set of air and fuel differential pressures across the firing range of the burner by splicing the air and fuel differential pressures corresponding to the most efficient excess air mode onto the adjusted air and fuel differential pressures derived at step (k);

(n) entering the air and fuel differential pressures derived at step (m) into the memory of the microprocessor, and (o) electrically adjusting the position of air flow and fuel flow valves by means of the microprocessor for any selected point on the firing range until the pressures sensed by the differential air and fuel flow sensors are equal to the optimal differential air and fuel flow pressures entered into the memory of the microprocessor for that particular point on the firing range.

* * * * *